US008613304B2

(12) United States Patent
Kraler et al.

(10) Patent No.: US 8,613,304 B2
(45) Date of Patent: Dec. 24, 2013

(54) DEVICE FOR DRIVING AND TURNING THE SLATS OF A VENETIAN BLIND

(75) Inventors: Franz Kraler, Abfaltersbach (AT); Eugen Karg, Berghülen (DE)

(73) Assignee: Franz Kraler, Abfaltersbach (AT)

( * ) Notice: Subject to any disclaimer, the term of this patent is extended or adjusted under 35 U.S.C. 154(b) by 725 days.

(21) Appl. No.: 12/693,111

(22) Filed: Jan. 25, 2010

(65) Prior Publication Data

US 2010/0186907 A1 Jul. 29, 2010

(30) Foreign Application Priority Data

Jan. 27, 2009 (AT) ..... A 132/2009

(51) Int. Cl.
*E06B 9/305* (2006.01)
*E06B 9/307* (2006.01)
*E06B 9/322* (2006.01)

(52) U.S. Cl.
USPC ..... 160/177 R; 160/405

(58) Field of Classification Search
USPC ..... 160/166.1, 168.1 R, 170, 173 R, 174 R, 160/176.1 R, 178.1 R, 177 R
See application file for complete search history.

(56) References Cited

U.S. PATENT DOCUMENTS

| | | | | |
|---|---|---|---|---|
| 3,135,369 | A * | 6/1964 | Nisenson et al. | 192/223.4 |
| 4,200,135 | A * | 4/1980 | Hennequin | 160/168.1 R |
| 5,123,472 | A * | 6/1992 | Nagashima et al. | 160/170 |
| 5,628,356 | A * | 5/1997 | Marocco | 160/170 |
| 6,644,376 | B2 * | 11/2003 | Wielen | 160/170 |
| 2004/0149399 | A1 * | 8/2004 | Colosio | 160/168.1 R |

FOREIGN PATENT DOCUMENTS

| | | |
|---|---|---|
| EP | 1 052 365 | 8/2000 |
| WO | WO 2004/059117 | 12/2003 |

* cited by examiner

*Primary Examiner* — Katherine Mitchell
*Assistant Examiner* — Jeremy Ramsey
(74) *Attorney, Agent, or Firm* — Notaro, Michalos & Zaccaria P.C.

(57) ABSTRACT

A device for driving and turning the slats of a Venetian blind, with a bearing housing, a winding spool for a carrier band, a turning mechanism for tilting the slats, an abutment flange for fixing the angular end position for the slats and an actuating element, which can be brought into operative connection to the turning mechanism by means of a lost motion mechanism, for arresting the slats in a working position during lowering of the Venetian blind, at least the winding spool, the turning mechanism, the abutment flange, the actuating element and the lost motion mechanism being arranged in a common bearing housing.

20 Claims, 7 Drawing Sheets

DEVICE FOR DRIVING AND TURNING THE SLATS OF A VENETIAN BLIND

The invention relates to a device for driving and turning the slats of a Venetian blind, with a bearing housing, a winding spool for a carrier band, a turning mechanism for tilting the slats, an abutment flange for fixing the angular end position for the slats and an actuating element, which can be brought into operative connection to the turning mechanism by means of a lost motion mechanism, for arresting the slats in a working position during lowering of the Venetian blind.

Venetian blinds with a drive and turning device are generally known, for example from WO 2004/059 117 A1 or EP 10 52 365 B1. In this case, what is known as the working position, in which the slats are arrested in an intermediate angular position, allows the Venetian blinds to be lowered in a state other than in the closed state, the lost motion mechanism serving to ensure that the actuating element is activated, after a reversal of the direction of rotation of the drive shaft, only after a predetermined number of revolutions.

The component size of the Venetian blind bearing, resulting from the combination of the bearing housing with an attachment module containing the lost motion mechanism and the actuating element, has been found to be a drawback of the previously known solutions for implementing a working position. The previously known constructions have the further problem of ensuring that the actuating element is indeed brought into operative connection to the turning mechanism or is brought out of engagement. As in the previously known solutions, this is ensured by loading the actuating element with a spring; this, in turn, has an adverse effect on the space required for this purpose.

Starting from this prior art, the object of the invention is to provide a device for driving and turning the slats of a Venetian blind that, while avoiding the drawbacks described hereinbefore, is a simply constructed solution requiring much less space than in the prior art.

The invention achieves this object in that at least the winding spool, the turning mechanism, the abutment flange, the actuating element and the lost motion mechanism are arranged in a common bearing housing.

A simply constructed and in addition stable solution can in this case be achieved if, according to a further exemplary embodiment of the invention, the bearing housing is embodied for rotatably receiving a drivable drive shaft penetrating the bearing housing, the turning mechanism for moving the slats between the angular end positions defined by means of the abutment flange has at least one turning element and an abutment element which can be brought releasably into engagement with the turning element and the actuating element is movable between an engagement position, arresting the abutment element in an angular intermediate position, and a release position, at least the winding spool, the turning mechanism and the lost motion mechanism being arranged in the bearing housing, surrounded thereby substantially in their entirety, so as to be rotatable by means of the drive shaft.

An arrangement of this type, in particular the arrangement of the actuating element and the lost motion mechanism in the one common bearing housing, provides a compact Venetian blind bearing having a longitudinal extension which is reduced by more than one third compared to the Venetian blind bearings known in the art having the same function.

In order to be able to keep down the overall height of the bearing housing, which is generally embodied in a substantially cylindrical manner and in the invention corresponds at the same time to the housing for the Venetian blind bearing as a whole, provision is made, according to a further exemplary embodiment of the invention, for in a manner known per se at least the winding spool, the turning mechanism and the lost motion mechanism to be arranged coaxially in the bearing housing.

A key basic idea of the invention therefore consists in arranging the overall mechanism required for raising, lowering, turning and arresting the slats in a working position in a common bearing housing, so that the size of the drive and turning device according to the invention with a working position function corresponds to the size of a Venetian blind bearing without a working position function.

In practice, that means that the difference between a standard bearing without a working position function and a Venetian blind bearing with a working position function resides merely in the adding or omitting of the actuating element, whereas in the solutions according to the prior art the difference between the standard bearings without a working position function and the Venetian blind bearings with a working position function resides in the arrangement of an add-on module which greatly increases the longitudinal extension of the standard bearing and in which the lost motion mechanism and the actuating element are arranged.

According to a further embodiment of the invention, provision is made for the actuating element to have a basic element and at least two engagement elements which are arranged thereon and of which a first engagement element is operatively connected or can be brought into operative connection to the turning mechanism and/or a second engagement element is operatively connected or can be brought into operative connection to the lost motion mechanism.

In order to be able to bring the first or the second engagement element of the actuating element into operative connection to the turning mechanism or the lost motion mechanism, it is necessary to change the position of the actuating element in the bearing housing. For this purpose, according to a preferred exemplary embodiment of the invention, provision is made for the actuating element to be movable between the release and engagement positions by converting a rotational movement of the drive shaft into an axial movement in the direction of the axis of rotation. A reliable mode of operation can be achieved when the actuating element is free from the loading of a force accumulator, in particular spring loading, at least during the movement between the release and engagement positions, and vice versa.

In contrast to the prior art, in which this movement of the actuating element is achieved precisely by loading by means of a force accumulator, in the invention the actuating element is switched between the release and input positions by rotating the drive shaft, as a result of which, on the one hand, malfunctions which can occur when using resilient force accumulators are avoided and, on the other hand, a solution is provided that is gentle on the material.

The invention further relates to a device for driving and turning the slats of a Venetian blind, with a bearing housing in which at least one winding spool for a carrier band and a turning mechanism for tilting the slats between defined angular end positions by means of a drive shaft are rotatably mounted, and an actuating element, which can be brought into operative connection to the turning mechanism, for arresting the slats in a working position during lowering of the Venetian blind, the actuating element being movable between an engagement position, arresting the abutment element in an angular intermediate position, and a release position.

In the solutions known in the art, the construction arrangement of the lost motion mechanism and the actuating element in a separate add-on module necessitates loading the actuating element by means of a resilient force accumulator in order to ensure that the actuating element is switched between the engagement and release positions. Apart from the increased space required therefor, this arrangement of an additional force accumulator also has an adverse effect on the manufacturing costs of a Venetian blind bearing with a working position function.

In order to bypass these problems, a further exemplary embodiment of the invention therefore provides for the actuating element to be arranged in the bearing housing so as to be movable substantially parallel to the axis of rotation R, the actuating element being moved between the release and engagement positions by means of the turning mechanism.

The arrangement of an additional force accumulator loading the actuating element is therefore dispensed with and the necessary movement of the actuating element is ensured in a simple manner by the turning mechanism which is present anyway.

For this purpose, a preferred embodiment of the invention provides for the actuating element to be arranged in the bearing housing so as to be able to swivel substantially parallel to the axis of rotation R. It has proven beneficial if the actuating element is mounted on the bearing housing so as to be able to swivel about an axis which is substantially normal to the axis of rotation R.

This preferred swivelable arrangement of the actuating element in the bearing housing allows a particularly short construction and is, on account of the rotatory mounting of the actuating element, a particularly smooth-running variant.

According to an alternative embodiment of the invention, provision is made for the actuating element to be arranged in the bearing housing so as to be displaceable linearly, substantially parallel to the axis of rotation R. A continuously guided, translatory movement can be achieved when a guide element, by means of which the actuating element is guided so as to be linearly displaceable in a corresponding guide embodied on the bearing housing, is arranged or embodied on the actuating element. It has proven beneficial if the guide is formed by a through-opening formed in the wall of the bearing housing.

According to a further exemplary embodiment of the invention, provision is furthermore made for the abutment element of the turning mechanism to be embodied in a disk-shaped manner and to have on its outer circumferential surface at least one deflecting element and an arresting element which interact with the actuating element, secure interlocking of the actuating element on the abutment element being achieved when the arresting element is embodied in a v-shaped manner.

As a result of a formation of this type of the circumferential surface of the abutment element, the abutment element can serve not only to arrest, as in the prior art, the slats in an angular intermediate position but, in addition, to cause the movement of the actuating element between the release and engagement positions and vice versa.

For this purpose, according to a further exemplary embodiment of the invention, provision is made for the actuating element to be driven by means of a wheel and shaft during its movement between the release and engagement positions, the shaft of the wheel and shaft being formed by the drive shaft and the wheel of the wheel and shaft being formed by the abutment element of the turning mechanism and the rotational movement of the abutment element being converted into a movement of the actuating element that is axial to the axis of rotation R substantially by means of the at least one deflecting element arranged on the circumferential surface of the abutment element.

In other words, the engagement elements of the actuating element on the circumferential surface of the abutment element are therefore moved back and forth substantially linearly in the axial direction of the drive shaft as a function of the direction of rotation of the drive shaft.

With respect to the configuration of the lost motion mechanism, the invention is merely subject to the restriction that the lost motion mechanism is accommodated in the one common bearing housing.

For this purpose, a preferred exemplary embodiment of the invention provides for the lost motion mechanism to be embodied in at least two parts and to have a disk-shaped basic member, which can be rotated by means of the drive shaft and has a spiral-shaped guide track for interacting with the actuating element, and a coupling element for interacting with the drive shaft. In the sense of a compact construction, it has proven particularly beneficial if the lost motion mechanism has precisely one basic member and a coupling element.

The rotary movement of the coupling element is in this case transmitted to the actuating element by means of the disk-shaped basic member, the coupling element being embodied, according to an exemplary embodiment of the invention, in an annular manner and having on its inner circumferential surface at least one cam-shaped projection via which the coupling element is mounted in a guide flute formed on the winding spool.

In order to allow the rotary movement of the drive shaft to be transmitted to the actuating element while at the same time ensuring a free run with only one coupling element and a basic member, a further exemplary embodiment of the invention provides for the coupling element to be arranged and embodied as a wobble ring. A stable and simply constructed solution provides for the inner circumferential surface of the coupling element to have an ellipsoidal outline.

According to a further exemplary embodiment, the transmission of the rotary movement of the coupling element to the basic member is ensured in that the coupling element has at least one entrainment element, which is arranged substantially normally to its main plane, for engaging with the spiral-shaped guide track of the disk-shaped basic member of the lost motion mechanism.

A lost motion mechanism configured in this way, in particular the embodiment of the coupling element according to the invention, allows the number of parts necessary for the lost motion mechanism to be reduced to two, whereas the solutions according to the prior art generally require three circular rings for transmitting the rotary movement and ensuring the free run.

It goes without saying that it is—as an alternative exemplary embodiment of the invention provides for—also entirely conceivable in the subject-matter of the application for the lost motion mechanism to be embodied in at least three parts and to have three circular ring-shaped coupling elements, of which one coupling element interacts with the actuating element.

A further exemplary embodiment of the invention provides for the abutment flange to be embodied, as is known per se, for receiving a plurality of abutment pins in different site positions, the different site positions each defining different angular end positions.

The invention further relates to a Venetian blind with a drive and turning device according to the invention.

The invention seeks further to disclose a method for swiveling the slats of a Venetian blind using a drive and turning device according to the invention, in which the slats are arrestable during the lowering of the Venetian blind in an angular intermediate position which is located between two angular end positions and in which the abutment element of the turning mechanism interacts with the actuating element.

According to the innovation, provision is in this case made for the actuating element to be brought, as a consequence of the drive shaft being rotated by the basic member of the lost motion mechanism, from its release position into the operative region of the turning mechanism, and the actuating element to be moved, if the drive shaft continues to be rotated by the abutment element of the turning mechanism, following the functional principle of a wheel and shaft, substantially parallel to the axis of rotation R until the actuating element has reached its engagement position in which it is engaged with the arresting element arranged on the outer circumferential surface of the abutment element.

In contrast to the prior art, the actuating element is therefore moved no longer by means of a resilient force loading the actuating element, but—as a preferred exemplary embodiment of the invention provides for—in accordance with step b) exclusively by converting the rotational movement of the drive shaft into a movement axial to the axis of rotation R, force being transmitted on the outer circumferential surface of the abutment element, at least partly by means of the at least one deflecting element which is arranged thereon and is operatively connected to the first engagement element of the actuating element.

Further advantages and details of the invention will be explained in greater depth based on the subsequent description of the figures with reference to the exemplary embodiments illustrated in the drawings, in which:

FIG. 1*a* to 1*d*' show different positions of the slats during lowering and raising of the Venetian blind;

FIGS. 1*a* to 1*d*' show the functional principle of a Venetian blind bearing with a working position function.

Whereas in conventional Venetian blinds the slats can be swiveled merely between two angular end positions A, B, the Venetian blinds generally being lowered in the closed state (angular end position B) and raised in the half-opened state (angular end position A), drive and turning devices with a working position function have an angular intermediate position C which is positioned between the angular end positions A, B and in which the slats are arrestable in the opened state, usually opened approx. 50° outward, so that the Venetian blind can be lowered in this working position of the slats, that is to say with daylight streaming in.

Figure 1A:
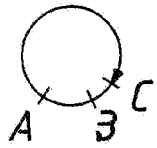

FIGS. 1*a* and 1*a*' show this working position function in which the slats 2 are held in the angular intermediate position C and the Venetian blind 3 is lowered by rotating the drive shaft toward the right in the direction indicated by the arrow.

Figure 1B:
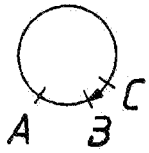

For completely closing the Venetian blind 3, the working position, that is to say the arresting of the slats 2 in the angular intermediate position C, is firstly canceled by changing the direction of rotation of the drive shaft before the slats 2 are swiveled into the angular end position B by way of a further change in the direction of rotation via the angular intermediate position C, so that the Venetian blind is closed in its entirety (FIGS. 1*b*, 1*b*').

Figure 1C:
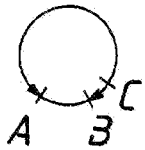
Figure 1D:
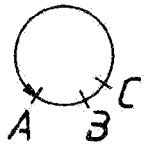
Figure 1A:
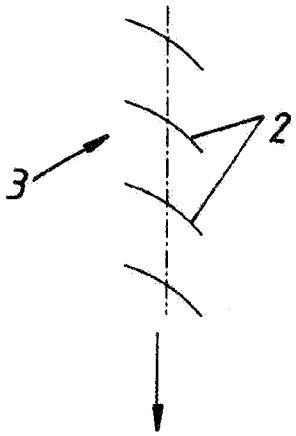
Figure 1B:
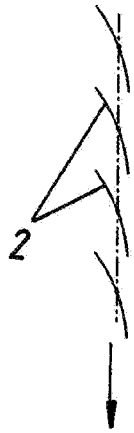
Figure 1C:
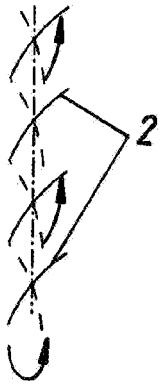
Figure 1D:
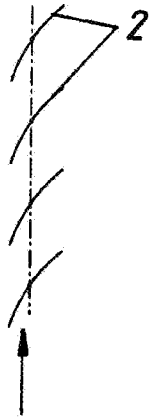

For raising the Venetian blind, the slats 2 of the Venetian blind 3 are, as illustrated in FIGS. 1*c*, 1*c*', turned by changing the direction of rotation from the angular end position B to the angular end position A, so that during raising (FIGS. 1*d*, 1*d*') the slats 2 are held in an open position corresponding to the angular intermediate position A.

Figure 2:
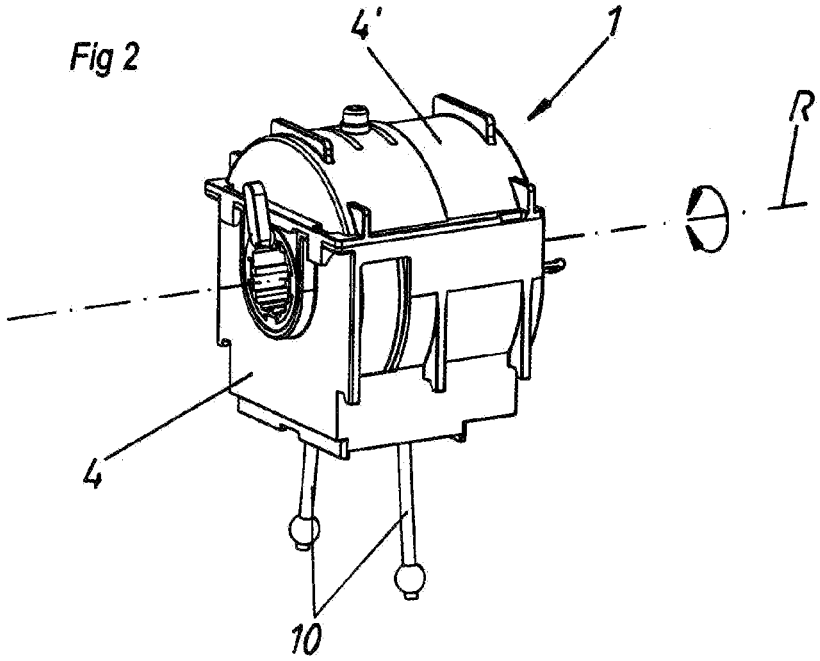
FIG. 2 is a perspective view of a drive and turning device according to the invention.

FIG. 2 is a perspective view of a drive and turning device 1 according to the invention, the bearing housing 4, 4' of which corresponds in terms of size to a standard bearing according to the prior art without a working position function. In the exemplary embodiment shown, the bearing housing has a bearing body 4 and a bearing cover 4' which are made from plastics material, in particular by injection molding, and can be connected to each other in a form-fitting manner. The bearing housing 4, 4' is embodied for rotatably receiving a drive shaft (not shown) which penetrates the bearing body 4 and is rotatable about the axis of rotation R.

Figure 3:
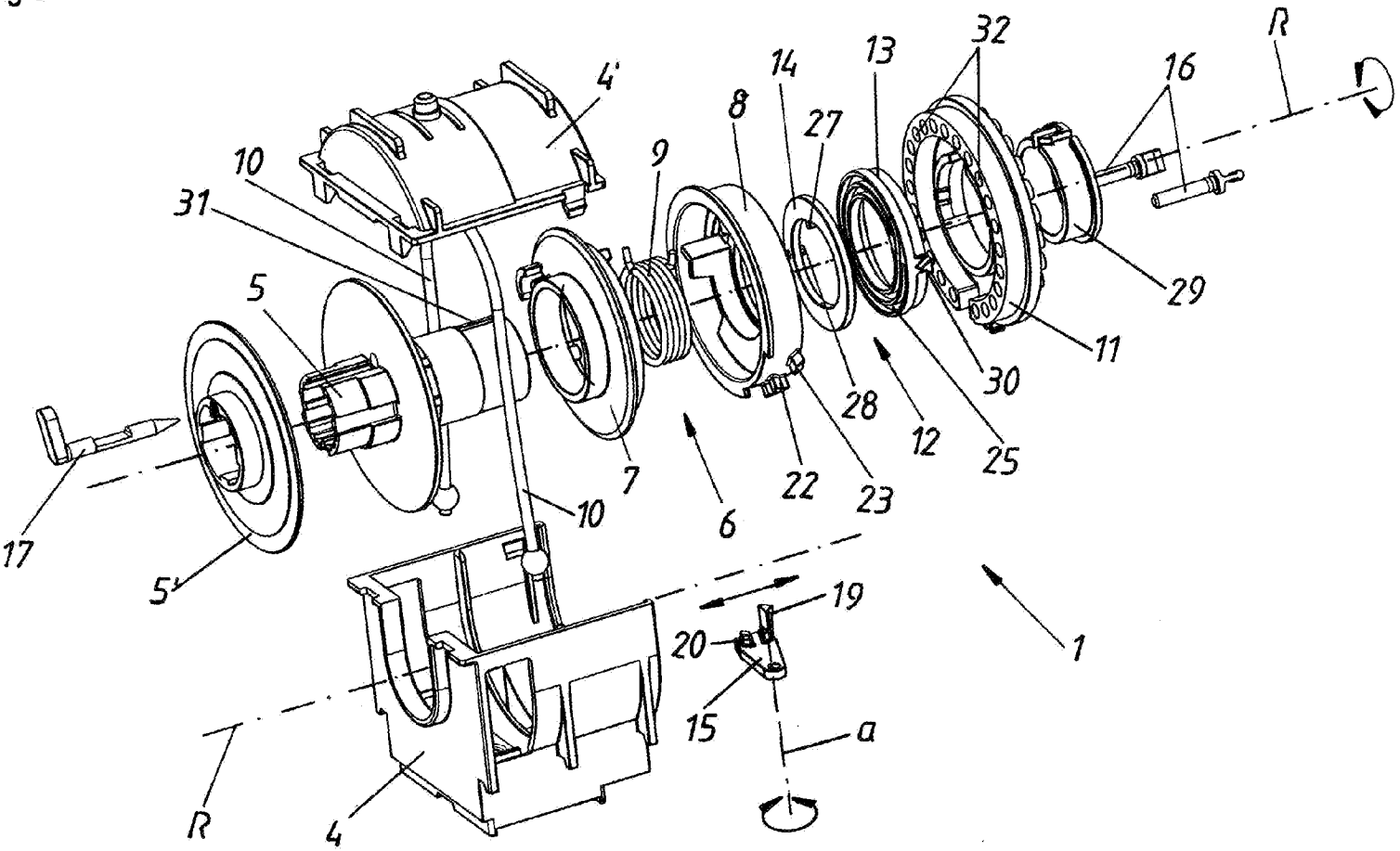
FIG. 3 is an exploded view of a first exemplary embodiment of the invention.

In the first exemplary embodiment according to FIG. 3, from left to right, the winding spool 5, the turning mechanism 6, the lost motion mechanism 12 and the abutment element 8 are arranged in the bearing body 4 coaxially with one another and so as to be able to rotate about the axis of rotation R.

The winding spool 5 is cylindrically embodied and has a disk-shaped, non-rotatably arranged flange and also a through-opening for the drive shaft. To the left of the disk-shaped flange, the spool disk 5' is non-rotatably attached to the winding spool 5. The spool disk 5' has, in addition to a through-opening for the drive shaft, a hole for receiving a carrier band pin 17 which serves to fasten the carrier band (not shown) to be wound up on the winding spool 5.

On the right side of the disk-shaped flange, the turning element 7 and the abutment element 8 of the turning mechanism 6 are rotatably arranged on the winding spool 5. The turning spring 9 is arranged in a manner known per se between the turning element 7 and the abutment element 8. The slot turning cord 10 is connected to the turning element 7 and is further connected to the slots 2 (not shown).

Between the abutment element 8 of the turning mechanism 6 and the abutment flange 11, which in the exemplary embodiment shown forms at the same time an end wall of the bearing body 4, 4', the lost motion mechanism 12 is also arranged coaxially so as to be able to rotate about the axis of rotation R. The lost motion mechanism 12 is embodied in two parts and has a disk-shaped basic member 13 with a through-opening for the drive shaft and a spiral-shaped guide track 25 and also a disk-shaped coupling element 14. The coupling element 14 and the basic member 13 are in the assembled state also mounted on the winding spool 5, the cam-shaped projection 27 being mounted on the inner circumferential surface of the coupling element 14 in the guide flute 31 on the winding spool 5.

The abutment flange 11 forms, as mentioned hereinbefore, an end face of the bearing body 4 and is non-rotatably connected thereto.

The adapter sleeve 29, which is arranged in the through-opening in the abutment flange 11, serves to center the drive shaft. It goes without saying that it would also be possible to adapt the through-opening for the adapter shaft in the abutment flange 11 directly to the cross-sectional area of the drive shaft and thus to center the drive shaft directly above the abutment flange 11.

The angular end positions A, B, between which the slats 2 can be tilted, are defined by means of the abutment pins 16 which are inserted into through-openings 32 in the abutment flange 11.

In other words, an elongate winding spool 5, which is embodied in the form of a hollow shaft, is arranged in the bearing housing 4, 4', one end side of which is formed by the abutment flange 11, the turning mechanism 6 and the lost motion mechanism 12 being mounted on the hollow shaft-shaped winding spool 5 which is rotatable by means of the drive shaft.

The actuating element 15 is in this exemplary embodiment arranged in the bearing body 4 so as to be able to swivel about the axis of rotation a, which runs substantially normally to the axis of rotation R, and can be brought into engagement with the abutment element 8 of the turning mechanism 6 via the first engagement element 20 and with the basic member 13 of the lost motion mechanism 12 via the second engagement element 19.

Figure 4:
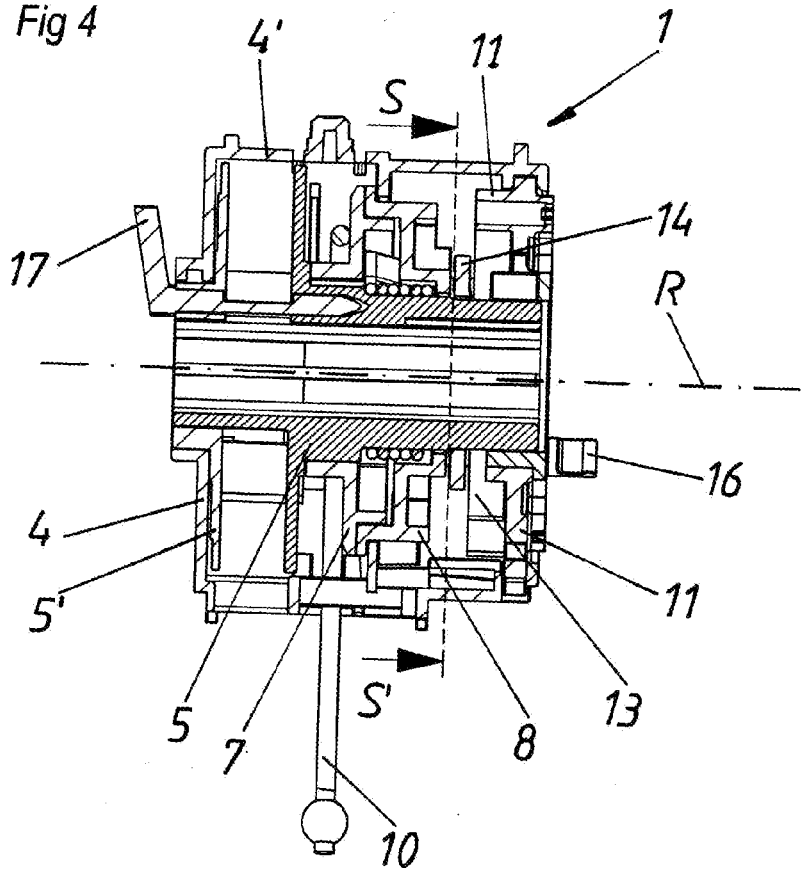
FIG. 4 is a longitudinal section through the exemplary embodiment according to FIG. 3.

FIG. 4 is a longitudinal section through the exemplary embodiment according to FIG. 3, showing in particular the short construction of the drive and turning device 1 according to the invention. This short longitudinal extension is possible as a result of the arrangement according to the invention of the individual parts 13, 14 of the lost motion mechanism 12 and also of the actuating element 15 between the turning mechanism 7 and the abutment flange 11.

Figure 5:
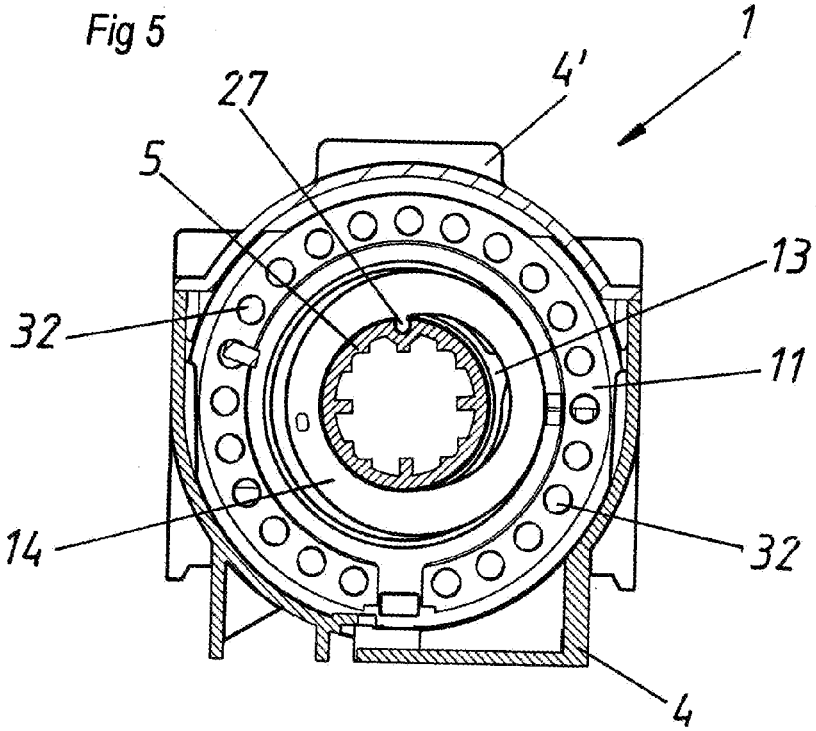
FIG. 5 is a cross section along the sectional line S-S' from FIG. 4.
Figure 6:
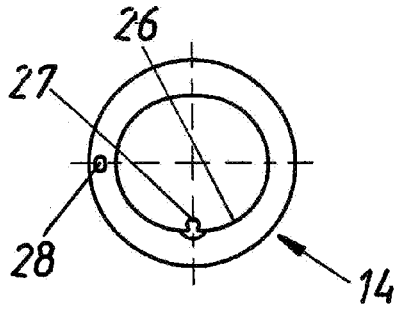
FIG. 6 is a view of a coupling element of the lost motion mechanism.
Figure 7:
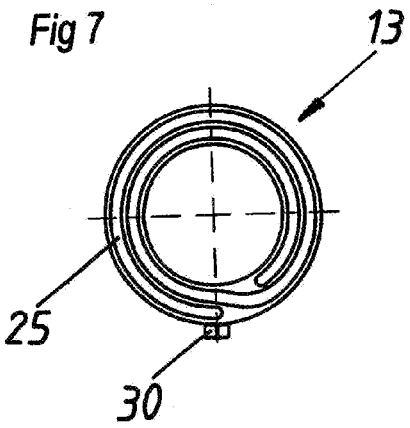
FIG. 7 is a view of a basic member of the lost motion mechanism.
Figure 8:
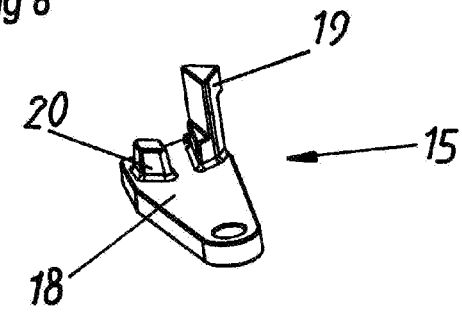
FIG. 8 shows the actuating element according to exemplary embodiment 3.

The disk-shaped embodiment of the coupling element 14 may be seen particularly clearly from FIG. 5, the inner outline running ellipsoidally (FIG. 6). A cam-shaped projection 27, with which the coupling element 14 is mounted in a form-fitting manner in the guide flute 31 on the winding spool 5, is arranged on the inner circumferential surface 26. Furthermore, an entrainment element 28, which is arranged substantially normally to the main plane of the coupling element 14 and engages in the assembled state with the spiral-shaped guide track 25 of the basic member 13 (FIG. 7), is embodied on the coupling element 14. An interlocking element 30, which interacts with the second engagement element 19 of the actuating element 15, is embodied on the outer circumferential surface of the basic member 13 of the lost motion mechanism 12.

The mode of operation of the lost motion mechanism 12 will be described hereinafter. During a rotation of the winding spool 5 by means of the drive shaft, the coupling element 14 jointly rotates therewith on account of its mounting by means of the cam-shaped projection 27 in the guide flute 31 of the winding spool 5. In this case, the entrainment element 28 of the coupling element 14 is moved in the spiral-shaped guide track 25 of the basic member 13 until it abuts against an end of the guide track 25. During a further rotary movement of the drive shaft, the coupling element 14 entrains the basic member 13, so that said basic member also rotates in the direction of rotation of the drive shaft. The interlocking element 30 is jointly moved as a result of the rotation, so that it subsequently enters into engagement with the second engagement element 19 of the actuating element 15, as a result of which the actuating element 15 is swiveled in such a way that the first actuating element 20 enters into engagement with the deflecting element 23 arranged on the outer circumferential surface of the abutment element 8 and is moved onward therefrom until it interlocks with the arresting element 22. During a further rotary movement of the drive shaft, the turning element 7 of the turning mechanism 6 is then arrested via the turning spring 9 and the abutment element 8, which is then stationary, in a position in which the slats 2 are in an angular intermediate position C.

A further exemplary embodiment of the invention is shown in FIGS. 9 to 12. This exemplary embodiment differs from the exemplary embodiment according to FIG. 3 merely in the different shaping of the actuating element 15. Like parts have been provided with the same reference numerals, and will therefore not be described again in detail.

Figure 9:
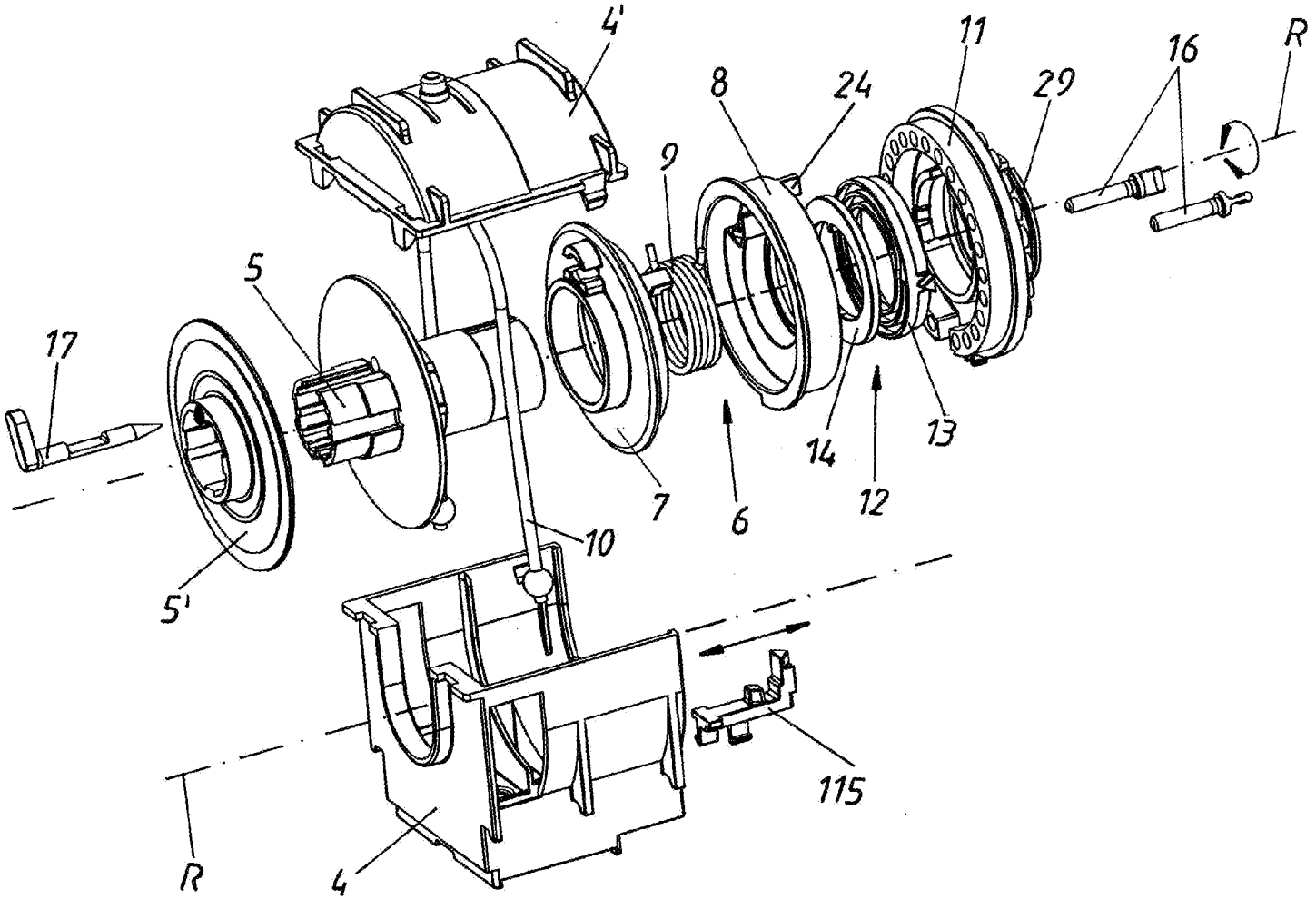
FIG. 9 is an exploded view of a further exemplary embodiment of the invention.
Figure 10:
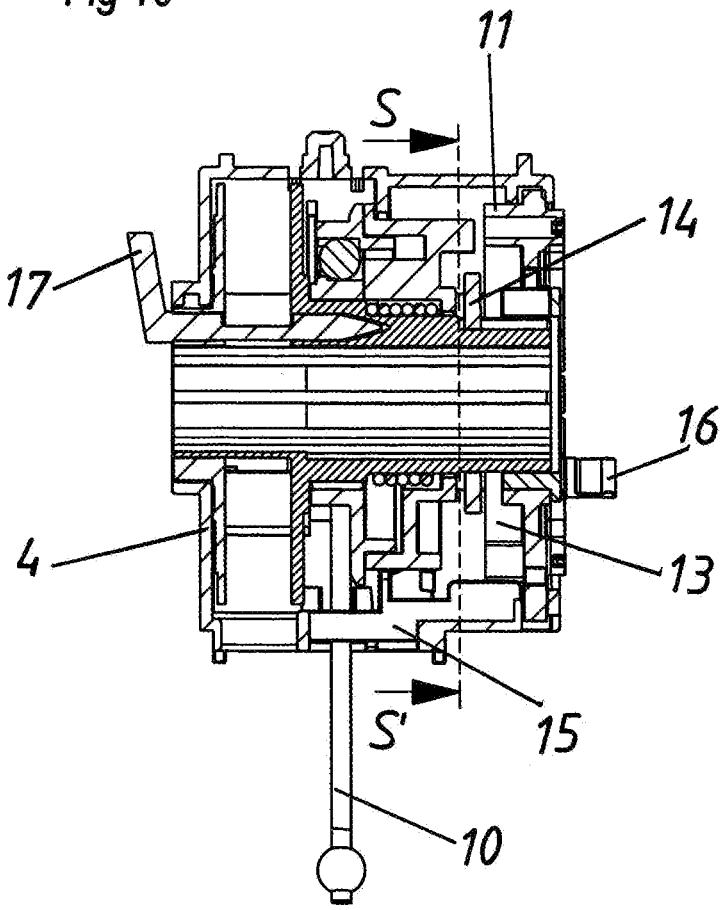
FIG. 10 is a longitudinal section through the exemplary embodiment according to FIG. 9.
Figure 11:
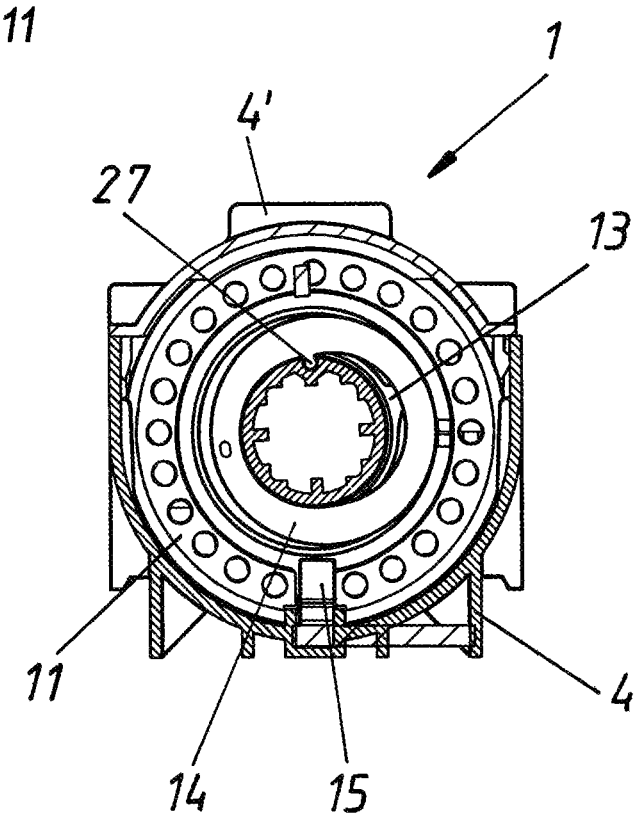
FIG. 11 is a cross section along the sectional line S-S' from FIG. 10.
Figure 12:
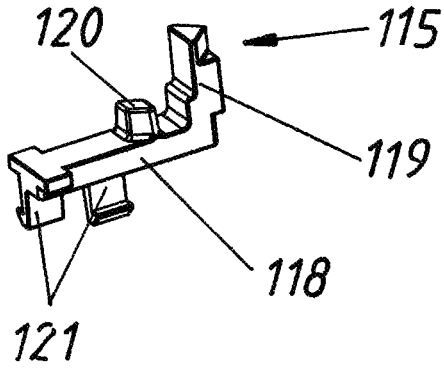
FIG. 12 shows the actuating element according to the exemplary embodiment as shown in FIG. 9.

FIG. 9 is an exploded view of this second exemplary embodiment. In contrast to the exemplary embodiment according to FIG. 3, the actuating element 115 is arranged in the bearing body 4 so as to be movable linearly, substantially parallel to the axis of rotation R. For this purpose, the actuating element 115 shown in FIG. 12 has an elongate basic element 118, embodied on which are guide elements 121 by means of which the actuating element 115 is movable with translatory guidance in a corresponding guide which is embodied on the bearing body 4 and can be formed by a slot, for example.

As previously in the first exemplary embodiment, the actuating element 115 is operably connectable to the basic member 13 of the lost motion mechanism 12 via the second engagement element 119 and to the abutment element 8 of the turning mechanism 6 via the second engagement element 120.

As may be seen from FIG. 9, the abutment element 8 has, in addition to the deflecting element 23 and the arresting element 22 (FIG. 3), also a stop element 24 with which the angle of rotation of the abutment element 8 is limited by means of the abutment pins 16 which define the angular end position A, B of the slats 2.

Although the invention has been explained in depth based on the exemplary embodiments shown, it goes without saying that the subject-matter of the application is not limited to the illustrated exemplary embodiments. On the contrary, measures and modifications which serve to implement the idea of the invention are entirely conceivable and desired. Thus, for example, the lost motion mechanism could be embodied in a plurality of parts and comprise three circular ring-shaped coupling elements. In principle, it would also be conceivable to embody the lost motion mechanism in the form of a planetary gear, for example. In this case, it would be expedient to arrange the lost motion mechanism in a separate attachment which is connectable to the bearing body.

A basic idea of the invention consists in any case in arranging the actuating element for ensuring the working position of the slats of a Venetian blind within the bearing body, so that the Venetian blind bearing for a standard solution without a working position and the Venetian blind bearing for a solution with a working position are constructed in substantially the same way and are the same size and it is simple to switch between these two types of Venetian blind by adding or omitting the actuating element.

The invention claimed is:

1. A device for driving and turning the slats of a Venetian blind, comprising:

a bearing housing, a winding spool for a carrier band, a turning mechanism for tilting the slats, an abutment flange for fixing an angular end position for the slats, an actuating element, which can be brought into operative connection to the turning mechanism by means of a lost motion mechanism, for arresting the slats in a working position during lowering of the Venetian blind, wherein at least the winding spool, the turning mechanism, the abutment flange, the actuating element and the lost motion mechanism are arranged in a common bearing housing, wherein the lost motion mechanism is arranged between the abutment flange and the winding spool, wherein the actuating element has a basic element and at least two engagement elements which are both arranged on the basic element, wherein a first engagement element is operatively connected or can be brought into operative connection to the turning mechanism and/or a second engagement element is operatively connected or can be brought into operative connection to the lost motion mechanism, wherein the actuating element, including the basic element and the at least two engagement elements, is embodied as a single object, wherein the actuating element is movable between a release position and an engagement position by converting a rotational movement of the drive shaft around its axis of rotation, the axis of rotation being along the length of the drive shaft, into a swiveling movement of the actuating element, and the swiveling movement of the actuating element including the entire actuating element and being about a swiveling axis, which swiveling axis is substantially perpendicular to the axis of rotation of the drive shaft.

2. The drive and turning device as claimed in claim 1, wherein the actuating element is not subject to spring loading pressure during the movement between release and engagement positions, or during movement between the engagement and release positions.

3. A device for driving and turning the slats of a Venetian blind according to claim 1, in which the at least one winding spool for a carrier band and the turning mechanism for tilting the slats between defined angular end positions are both mounted within the bearing housing so as to be rotatable by means of a drive shaft, the drive shaft being elongated and having an axis of rotation along its length, and the actuating element, which can be brought into operative connection to the turning mechanism, for arresting the slats in a working position during lowering of the Venetian blind, the actuating element being movable between an engagement position arresting an abutment element in an angular intermediate position, and a release position, wherein the actuating element is arranged in the bearing housing so as to be movable substantially parallel to the axis of rotation, the actuating element being moved between the release and engagement positions by means of the turning mechanism.

4. A device for driving and turning the slats of a Venetian blind, comprising:

a bearing housing, a winding spool for a carrier band, a turning mechanism for tilting the slats, an abutment flange for fixing an angular end position for the slats, an actuating element, which can be brought into operative connection to the turning mechanism by means of a lost motion mechanism, for arresting the slats in a working position during lowering of the Venetian blind, wherein at least the winding spool, the turning mechanism, the abutment flange, the actuating element and the lost motion mechanism are arranged in a common bearing housing, wherein the lost motion mechanism is arranged between the abutment flange and the winding spool, wherein at least one winding spool for a carrier band and a turning mechanism for tilting the slats between defined angular end positions are both mounted within the bearing housing so as to be rotatable by means of a drive shaft, the drive shaft being elongated and having an axis of rotation along its length, and an actuating element, which can be brought into operative connection to the turning mechanism, for arresting the slats in a working position during lowering of the Venetian blind, the actuating element being movable between an engagement position arresting the abutment element in an angular intermediate position, and a release position, wherein the actuating element is arranged in the bearing housing so as to be movable substantially parallel to the axis of rotation, the actuating element being moved between the release and engagement positions by means of the turning mechanism, wherein the actuating element is arranged in the bearing housing so that the entire actuating element as a whole is able to swivel substantially parallel to the axis of rotation of the drive shaft.

5. The drive and turning device as claimed in claim 4, wherein the actuating element is mounted on the bearing housing so as to be able to swivel about an axis which is substantially normal to the axis of rotation.

6. The drive and turning device as claimed in claim 3, wherein the actuating element is arranged in the bearing housing so as to be displaceable linearly, substantially parallel to the axis of rotation.

7. The drive and turning device as claimed in claim 6, wherein a guide element, by means of which the actuating element is guided so as to be linearly displaceable in a corresponding guide embodied on the bearing housing, is arranged or embodied on the actuating element.

8. The drive and turning device as claimed in claim 7, wherein the guide is formed by a through-opening formed in the wall of the bearing housing.

9. The drive and turning device as claimed in claim 3, wherein the abutment element of the turning mechanism is embodied in a disk-shaped manner and has on its outer circumferential surface at least one deflecting element and an arresting element which interact with the actuating element.

10. The drive and turning device as claimed in claim 9, wherein the arresting element is embodied in a v-shaped manner.

11. A device for driving and turning the slats of a Venetian blind, comprising:

a bearing housing, a winding spool for a carrier band, a turning mechanism for tilting the slats, an abutment flange for fixing an angular end position for the slats, an actuating element, which can be brought into operative connection to the turning mechanism by means of a lost motion mechanism, for arresting the slats in a working position during lowering of the Venetian blind, wherein at least the winding spool, the turning mechanism, the abutment flange, the actuating element and the lost motion mechanism are arranged in a common bearing housing, wherein the lost motion mechanism is arranged between the abutment flange and the winding spool wherein the abutment element of the turning mechanism is embodied in a disk-shaped manner and has on its outer circumferential surface at least one deflecting element and an arresting element which interact with the actuating element, wherein the actuating element is driven during its movement between release and engagement positions by means of a wheel and shaft, the shaft being formed by the drive shaft and the wheel being formed by the abutment element of the turning mechanism, the rotational movement of the abutment element around a rotation axis being converted into a pivoting movement of the actuating element around a pivot axis which pivot axis is not parallel to the rotation axis, and the conversion of rotational movement into pivoting movement being achieved substantially by means of the at least one deflecting element arranged on the circumferential surface of the abutment element.

12. The drive and turning device as claimed in claim 1, wherein the lost motion mechanism is embodied in at least two parts and comprises a disk-shaped basic member, which can be rotated by means of the drive shaft and has a spiral-shaped guide track for interacting with the actuating element, and also a coupling element for interacting with the drive shaft.

13. The drive and turning device as claimed in claim 12, wherein the lost motion mechanism has not more than one and not less than one basic member and a coupling element.

14. The drive and turning device as claimed in claim 12, wherein the coupling element is embodied in an annular manner comprising an inner circumferential surface defining an opening within the coupling element, and has on its inner circumferential surface at least one cam-shaped projection which is arranged and embodied for engaging with the drive shaft.

15. A device for driving and turning the slats of a Venetian blind, comprising:

a bearing housing, a winding spool for a carrier band, a turning mechanism for tilting the slats, an abutment flange for fixing an angular end position for the slats and an actuating element, which can be brought into operative connection to the turning mechanism by means of a lost motion mechanism, for arresting the slats in a working position during lowering of the Venetian blind, wherein at least the winding spool, the turning mechanism, the abutment flange, the actuating element and the lost motion mechanism are arranged in a common bearing housing, wherein the lost motion mechanism is arranged between the abutment flange and the winding spool, wherein the lost motion mechanism is embodied in at least two parts and comprises a disk-shaped basic member, which can be rotated by means of the drive shaft and has a spiral-shaped guide track for interacting with the actuating element, and also a coupling element for interacting with the drive shaft, wherein the coupling element is embodied in an annular manner comprising an inner circumferential surface defining an opening within the coupling element, and has on its inner circumferential surface at least one cam-shaped projection which is arranged and embodied for engaging with the drive shaft, and wherein the coupling element is arranged and embodied as a wobble ring, the wobble ring having an inner circumferential surface which, even disregarding the cam-shaped projection, has a non-uniform diameter.

16. A device for driving and turning the slats of a Venetian blind, comprising:

a bearing housing, a winding spool for a carrier band, a turning mechanism for tilting the slats, an abutment flange for fixing an angular end position for the slats and an actuating element, which can be brought into operative connection to the turning mechanism by means of a lost motion mechanism, for arresting the slats in a working position during lowering of the Venetian blind, wherein at least the winding spool, the turning mechanism, the abutment flange, the actuating element and the lost motion mechanism are arranged in a common bearing housing, wherein the lost motion mechanism is arranged between the abutment flange and the winding spool, wherein the lost motion mechanism is embodied in at least two parts and comprises a disk-shaped basic member, which can be rotated by means of the drive shaft and has a spiral-shaped guide track for interacting with the actuating element, and also a coupling element for interacting with the drive shaft, wherein the coupling element is embodied in an annular manner comprising an inner circumferential surface defining an opening within the coupling element, and has on its inner circumferential surface at least one cam-shaped projection which is arranged and embodied for engaging with the drive shaft, and wherein the inner circumferential surface of the coupling element has an oblong ellipsoidal outline with the at least one cam-shaped projection projecting from the otherwise ellipsoidal surface.

17. The drive and turning device as claimed in claim 14, wherein the annular coupling element is generally in a form of a flat disk having an opening at its center and at least one generally flat side, the opening being defined by the inner circumferential surface;

the coupling element having at least one entrainment element protruding out from a generally flat side for engaging with the spiral-shaped guide track of the disk-shaped basic member of the lost motion mechanism.

18. The drive and turning device as claimed in claim 1, wherein the lost motion mechanism is embodied in at least three parts and has three circular ring-shaped coupling elements, of which one coupling element interacts with the actuating element.

19. The drive and turning device as claimed in claim 1, wherein the abutment flange is embodied, as is known per se, for receiving a plurality of abutment pins in different site positions, the different site positions each defining different angular end positions.

20. A Venetian blind with a drive and turning device as claimed in claim 5.

* * * * *